US011768459B2

(12) United States Patent
Sasaki

(10) Patent No.: US 11,768,459 B2
(45) Date of Patent: Sep. 26, 2023

(54) IMAGE FORMING APPARATUS

(71) Applicant: Konica Minolta, Inc., Tokyo (JP)

(72) Inventor: Kunitomo Sasaki, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/835,187

(22) Filed: Jun. 8, 2022

(65) Prior Publication Data

US 2022/0404758 A1 Dec. 22, 2022

(30) Foreign Application Priority Data

Jun. 16, 2021 (JP) ..... 2021-100460

(51) Int. Cl.

| | |
|---|---|
| ***G03G 21/16*** | (2006.01) |
| ***G03G 15/00*** | (2006.01) |
| ***G03G 15/01*** | (2006.01) |
| ***G03G 21/00*** | (2006.01) |

(52) U.S. Cl.

CPC ..... *G03G 21/169* (2013.01); *G03G 15/0131* (2013.01); *G03G 15/5058* (2013.01); *G03G 21/0011* (2013.01)

(58) Field of Classification Search

CPC ..... G03G 21/0005; G03G 21/0011; G03G 21/0035; G03G 21/0041; G03G 21/0047; G03G 21/0052; G03G 21/0058; G03G 21/4464; G03G 21/168; G03G 15/5033; G03G 15/5041; G03G 15/5054; G03G 15/5058; G03G 15/5062; G03G 15/55; H04N 1/00045

See application file for complete search history.

(56) References Cited

U.S. PATENT DOCUMENTS

| | | | | |
|---|---|---|---|---|
| 2002/0113856 | A1* | 8/2002 | Suzuki | H04N 1/4015 347/133 |
| 2008/0056736 | A1* | 3/2008 | Katsumi | G03G 15/5079 399/8 |
| 2020/0174413 | A1* | 6/2020 | Tadaki | G03G 15/5041 |
| 2022/0311908 | A1* | 9/2022 | Watanabe | H04N 1/00045 |

FOREIGN PATENT DOCUMENTS

| | | | |
|---|---|---|---|
| JP | H02-146563 A | | 6/1990 |
| JP | 2012-083588 A | | 4/2012 |
| JP | 2014137551 A | * | 7/2014 |
| JP | 2020-086303 A | | 6/2020 |

OTHER PUBLICATIONS

Machine translation of JP-2014137551-A. Jul. 2014. (Year: 2014).*

* cited by examiner

*Primary Examiner* — Carla J Therrien

(74) *Attorney, Agent, or Firm* — LUCAS & MERCANTI, LLP

(57) ABSTRACT

An image forming apparatus includes: a toner image former that forms a toner image on an outer peripheral surface of a photosensitive rotating body and that transfers the toner image having been formed onto a transfer receiving object; a detector that detects a grayscale abnormality of the toner image on the photosensitive rotating body or the transfer receiving object; a cleaner that cleans the outer peripheral surface of the photosensitive rotating body; and a hardware processor that causes the cleaner to clean when the detector detects the grayscale abnormality at a same position in a main scanning direction per circumferential length of the photosensitive rotating body in a sub-scanning direction.

24 Claims, 9 Drawing Sheets

IMAGE FORMING APPARATUS

The entire disclosure of Japanese patent Application No. 2021-100460, filed on Jun. 16, 2021, is incorporated herein by reference in its entirety.

BACKGROUND

Technological Field

The present disclosure relates to an image forming apparatus, and more particularly to a technique for efficiently eliminating local image noise generated by adhesion of a discharge product to a surface of a photoreceptor.

Description of the Related Art

An electrophotographic image forming apparatus performs an electrophotographic process of forming an electrostatic latent image by exposing a uniformly charged surface of a photoreceptor, developing the electrostatic latent image to form a toner image, and transferring the toner image to a transfer receiving material such as a recording sheet. In the charging step of charging the surface of the photoreceptor among these steps, a discharge product such as ozone or nitrogen oxide is generated by ionization of air.

The discharge product generated by a charging device is dispersed and adheres to various places inside the image forming apparatus. The discharge product is likely to adhere to the photoreceptor particularly because the photoreceptor is located especially close to the charging device and faces the charging device. When the discharge product adhering to the surface of the photoreceptor absorbs moisture, electric resistance decreases and conductivity increases. When an electrification charge at an unexposed portion on the surface of the photoreceptor flows to an exposed portion on the surface of the photoreceptor via such a discharge product and the unexposed portion is neutralized, image noise occurs (ozone blur).

The ozone blur is eliminated by removing the discharge product adhering to the surface of the photoreceptor. In the electrophotographic image forming apparatus, transfer-residual toner remaining on the surface of the photoreceptor after the transfer step for transferring the toner image is scraped off with a cleaning member such as a cleaning blade and removed. Thus, the discharge product is scraped off from the surface of the photoreceptor together with the transfer-residual toner and discarded while image forming processing is executed.

On the other hand, when time elapses without execution of the image forming processing at night or the like, the discharge product is likely to accumulate on the surface of the photoreceptor. Particularly in a region of the surface of the photoreceptor facing the charging device, adhesion of the discharge product is remarkable, and therefore, ozone blur is also remarkable.

In a case where deterioration in image quality due to ozone blur occurs when a user uses the image forming apparatus, the image quality needs to be quickly recovered. To this end, the user replaces an image forming unit. Therefore, the lifetime of the image forming unit is significantly shortened in a sense that the photoreceptor that should have been used if the discharge product does not adhere cannot be used. In addition, when a period (down time) during which the user cannot use the image forming apparatus in order to replace the image forming unit increases, convenience for the user is deteriorated.

For such ozone blur, a technique of providing a recovery mode for removing a discharge product from the surface of the photoreceptor by using, for example, a cleaning member or the like has been proposed. In addition, in order to reliably remove the discharge product, a cleaning member having a high rubbing force with the surface of the photoreceptor has been proposed. With these techniques, the discharge product can be removed even when the image forming processing is not executed, so that ozone blur can be controlled.

However, it takes time and effort for the user visually recognizing the ozone blur on a printed matter to activate the recovery mode. In addition, when the recovery mode is periodically applied, for example, every morning, regardless of the occurrence of ozone blur, the life of the photoreceptor is unnecessarily shortened because of wear of the photoreceptor due to rubbing with the cleaning member. Particularly when a cleaning member having a high rubbing force with respect to the surface of the photoreceptor is used, wear of the photoreceptor is accelerated, so that the lifetime of the image forming unit is significantly shortened.

For this reason, there has been a demand for a discharge-product removing technique that enables reduction of wear of a photoreceptor without requiring time and effort for a user. That is, it is desirable to accurately detect the occurrence of the ozone blur and apply the recovery mode only when the ozone blur occurs.

For example, considering that a discharge product is conducted by humidification, there is known a technique of detecting temperature and humidity around a photoreceptor and applying a recovery mode when the temperature and humidity reach a temperature and humidity at which ozone blur is likely to occur. However, in this conventional technique, the recovery mode is applied when just the temperature and humidity around the photoreceptor reach a predetermined temperature and humidity even if no discharge product adheres to the surface of the photoreceptor. Therefore, this technique cannot always sufficiently reduce the wear of the photoreceptor.

In addition, there is also known a technique of detecting a driving torque for rotating a photoreceptor drum and a surface potential of the photoreceptor, determining that a discharge product adheres when the driving torque and the surface potential vary beyond a predetermined variation range, and applying a recovery mode.

However, it is difficult to accurately detect the adhesion state of the discharge product from the driving torque and the surface potential of the photoreceptor drum. Therefore, if the recovery mode is applied as a result of erroneous detection of adhesion of the discharge product although the discharge product does not actually adhere, wear of the photoreceptor cannot be sufficiently reduced. On the contrary, when it is erroneously detected that the discharge product does not adhere although the discharge product actually adheres, the recovery mode is not applied. Thus, ozone blur cannot be sufficiently reduced.

Furthermore, a conventional technique of forming a detection pattern for detecting ozone blur, detecting the density of the formed detection pattern on a photoreceptor or an intermediate transfer body, and applying a recovery mode when the detected density varies beyond a threshold has been proposed (see, for example, JP 2020-086303 A, JP 2012-083588 A, and JP 2-146563 A). These conventional techniques are expected to reduce erroneous detection of ozone blur, because the occurrence of ozone blur is directly detected from the density variation of the detection pattern.

As described above, it is known that the discharge product is likely to accumulate particularly in a region of the surface of the photoreceptor facing the charging device during a period in which the photoreceptor drum stops rotating for a long time. The region facing the charging device extends over the entire width in the rotation axis direction (main scanning direction) of the photoreceptor drum, but is only a part of the surface of the photoreceptor in the circumferential direction (sub-scanning direction).

Focusing on this point, some of the conventional techniques described above detect the position where the discharge product adheres in the sub-scanning direction by forming a detection pattern for detecting the discharge product only in a part in the main scanning direction (JP 2020-086303 A and JP 2012-083588 A).

In addition, the above conventional techniques include a technique of forming a detection pattern on an image carrier at predetermined intervals in the sub-scanning direction, and detecting an occurrence of image noise due to the discharge product from the density waveform of the detection pattern (JP 2-146563 A).

Meanwhile, in recent years, the application range of an electrophotographic image forming apparatus has been continuously expanded, and high-definition printed matters for commercial use are to be included in the category Image forming apparatuses for commercial use are demanded to have higher reliability and even durability.

In order to form a high-definition image, it is required to eliminate ozone blur by completely detecting and removing discharge products locally attached in the main scanning direction.

In addition, in order to achieve high reliability and durability, it is necessary to reduce wear of the photoreceptor by preventing the recovery mode from being unnecessarily applied due to erroneous detection of a discharge product.

With respect to such a demand, when the discharge product locally adheres only to a part between one end and the other end in the main scanning direction on the outer peripheral surface of the photoreceptor drum, the above-described conventional technique may not detect the discharge product because the detection pattern for detecting the discharge product formed only in a part in the main scanning direction may deviate from the adhesion position where the discharge product adheres.

In addition, even if the detection pattern is formed over the entire width in the main scanning direction, if the discharge product adheres only to a part in the main scanning direction, a total value of the time during which the difference between a density measurement signal and a reference value is detected is short, and thus, there is a possibility that the discharge product cannot be detected.

If the discharge product cannot be detected, it is not possible to apply the recovery mode to remove the discharge product from the surface of the photoreceptor and, therefore, high definition image quality cannot be achieved.

However, if the recovery mode is applied regardless of the adhesion of the discharge product, the wear of the photoreceptor is accelerated, and thus, it is not possible to meet the requirement regarding high reliability and durability.

SUMMARY

The present disclosure has been accomplished in view of the above-described problems, and an object of the present disclosure is to provide an image forming apparatus that detects ozone blur locally generated in the main scanning direction and removes a discharge product that has caused the ozone blur.

To achieve the abovementioned object, according to an aspect of the present invention, an image forming apparatus reflecting one aspect of the present invention comprises a toner image former that forms a toner image on an outer peripheral surface of a photosensitive rotating body and that transfers the toner image having been formed onto a transfer receiving object; a detector that detects a grayscale abnormality of the toner image on the photosensitive rotating body or the transfer receiving object; a cleaner that cleans the outer peripheral surface of the photosensitive rotating body; and a hardware processor that causes the cleaner to clean when the detector detects the grayscale abnormality at a same position in a main scanning direction per circumferential length of the photosensitive rotating body in a sub-scanning direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of an image forming apparatus according to the present invention will be described with reference to the drawings. However, the scope of the invention is not limited to the disclosed embodiments.

[1] Configuration of Image Forming Apparatus

First, the configuration of the image forming apparatus according to the present embodiment will be described.

Figure 1:
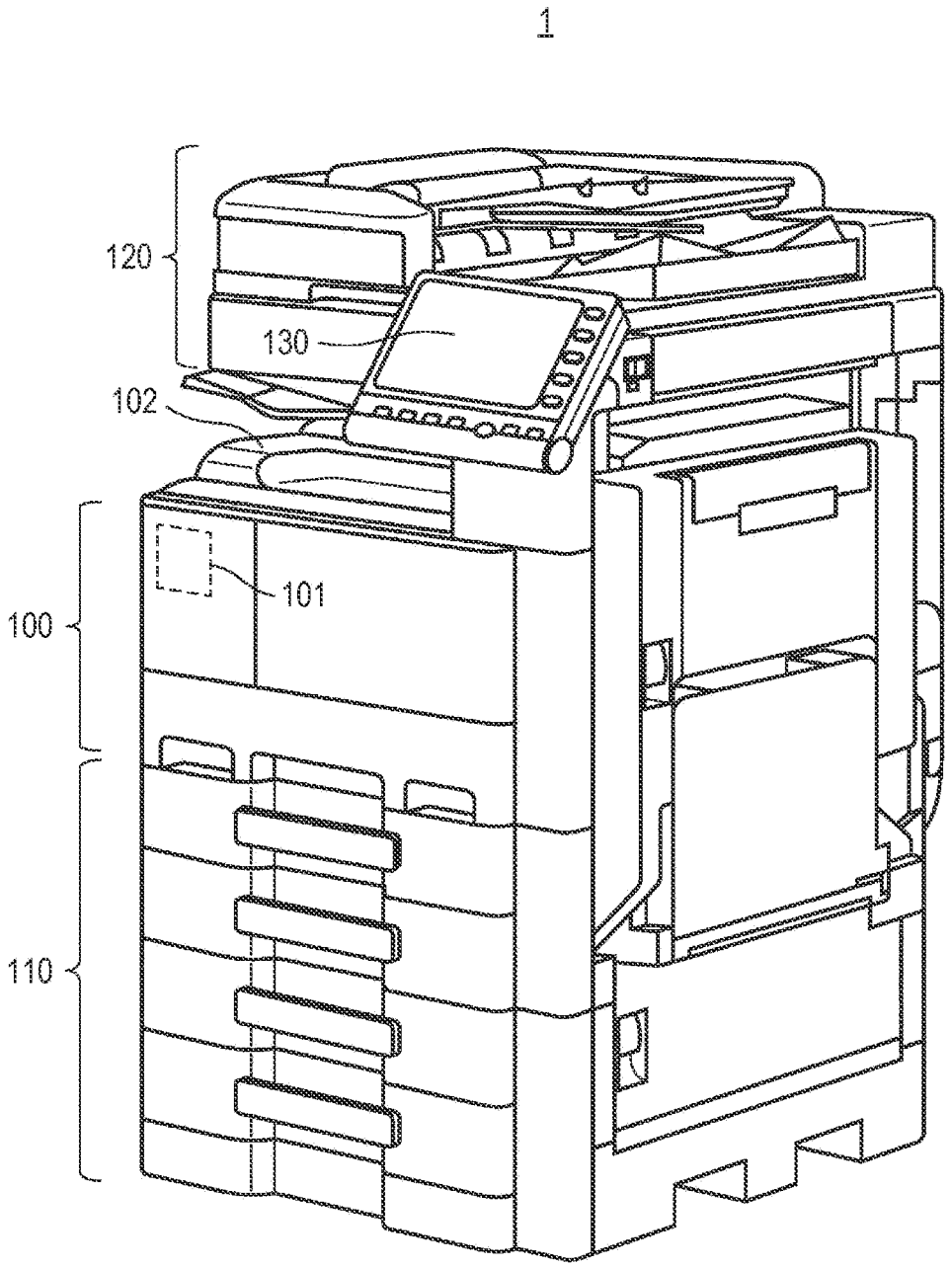
FIG. 1 is an external perspective view illustrating a main configuration of an image forming apparatus according to an embodiment of the present disclosure.

An image forming apparatus 1 according to the present embodiment is a so-called tandem color multi-function peripheral (MFP), and includes an image former 100, a sheet feeder 110, an image reader 120, and an operation panel 130 as illustrated in FIG. 1. The image reader 120 reads an image from a document and generates image data.

The image former 100 forms an image using image data generated by the image reader 120 and image data received via a communication network such as a local area network (LAN) or the Internet. In this case, an image is formed on a recording sheet supplied by the sheet feeder 110, and then the recording sheet on which the image is formed is ejected onto a sheet exit tray 102.

The image former 100 includes a controller 101. The controller 101 monitors and controls operations and states of the image former 100, the sheet feeder 110, the image reader 120, and the operation panel 130.

[2] Configuration of Image Former 100

Next, a configuration of the image former 100 will be described.

Figure 2:
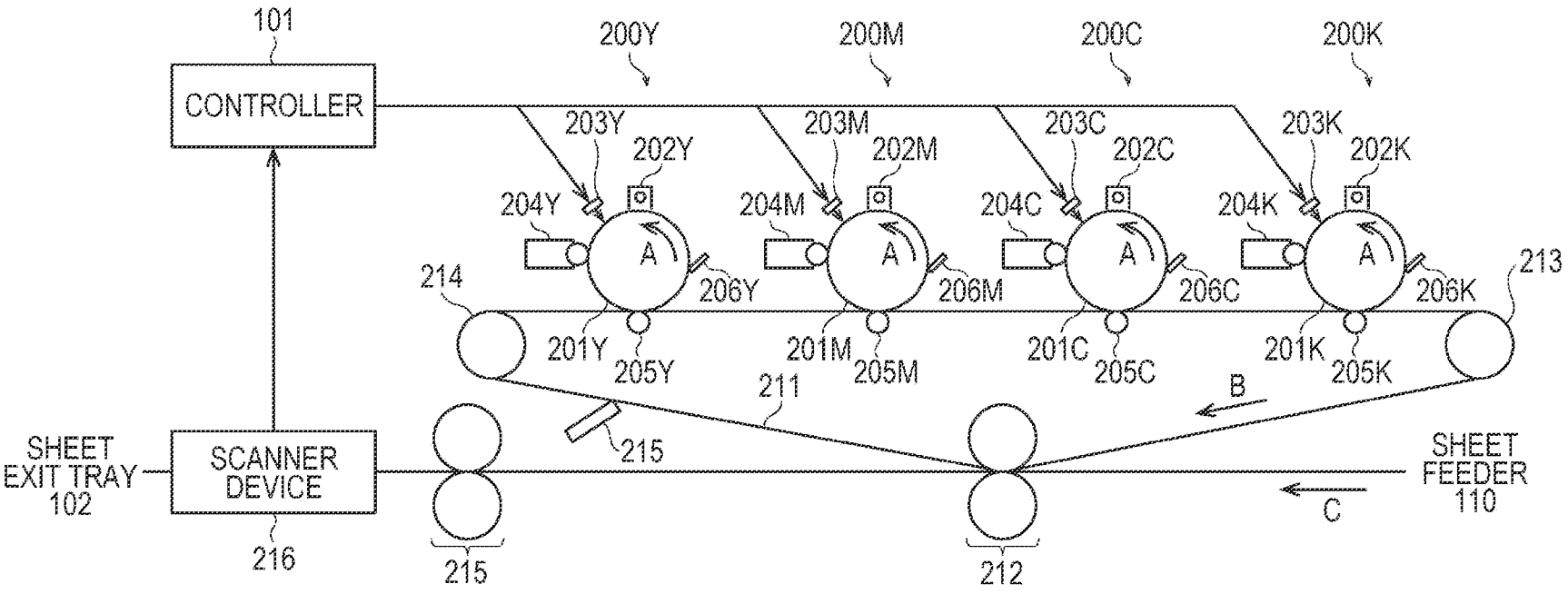
FIG. 2 is a diagram illustrating a main configuration of an image former included in the image forming apparatus.

As illustrated in FIG. 2, the image former 100 includes image forming units 200Y, 200M, 200C, and 200K that form toner images of respective colors of yellow (Y), magenta (M), cyan (C), and black (K). In the following, when the configuration common to the image forming units 200Y, 200M, 200C, and 200K is described, the characters YMCK representing the toner colors are omitted from the reference signs.

The image forming unit 200 includes a charging device 202, an exposure device 203, a developing device 204, a primary transfer roller 205, and a cleaning device 206 which are sequentially provided along an outer peripheral surface of a photoreceptor drum 201 as a photosensitive rotating body.

(2-1) Photoreceptor Drum 201

The photoreceptor drum 201 includes a photoreceptor layer formed along an outer peripheral surface and having a cylindrical outer peripheral surface. The outer peripheral surface of the photoreceptor layer is covered with a protective layer. The photoreceptor drum 201 is rotationally driven in a direction of an arrow A by a photoreceptor drum drive motor 411 (illustrated in FIG. 4).

The photoreceptor layer of the photoreceptor drum 201 includes a resin containing an organic photoconductor, and is, for example, an organic photoreceptor layer formed on the outer peripheral surface of a drum-shaped metal substrate. Examples of usable resin constituting the photosensitive layer include a polycarbonate resin, a silicone resin, a polystyrene resin, an acrylic resin, a methacrylic resin, an epoxy resin, a polyurethane resin, a vinyl chloride resin, and a melamine resin.

(2-2) Charging Device 202

The charging device 202 uniformly charges the outer peripheral surface of the photoreceptor drum 201. When doing so, the charging device 202 generates a discharge product such as ozone or nitrogen oxides (NOx). The generated discharge product is dispersed and adheres to the inside of the image forming apparatus 1, particularly, the outer peripheral surface of the photoreceptor drum 201. In addition, when the rotation of the photoreceptor drum 201 is stopped for a long time after an image is formed, the discharge product is likely to accumulate in a region facing the charging device 202 on the outer peripheral surface of the photoreceptor drum.

The present embodiment will describe a case where a scorotron charging device is used as the charging device 202 as an example, but the present disclosure is obviously not limited thereto, and a scorotron charging device may be used, or a charging roller may be used. When applied with a DC bias or an AC bias in which an AC voltage is superimposed on a DC voltage, the charging device 202 causes electric discharge in an electrode portion, and uniformly charges the outer peripheral surface of the photoreceptor drum 201 to a predetermined charge potential. When a charging roller is used as the charging device 202, electric discharge occurs on the surface of the roller, by which the outer peripheral surface of the photoreceptor drum 201 is charged.

(2-3) Exposure Device 203

The exposure device 203 irradiates the outer peripheral surface of the photoreceptor drum 201 with a laser beam modulated according to an image signal received from the controller 101. In an exposed region irradiated with the laser beam on the outer peripheral surface of the photoreceptor drum 201, the photoreceptor is conducted, and the electrification charge on the outer peripheral surface is lost. In an unexposed region not irradiated with the laser beam, the electrification charge on the outer peripheral surface is maintained. In this way, an electrostatic latent image is formed.

(2-4) Developing Device 204

The developing device 204 develops the electrostatic latent image and forms a toner image by supplying toner onto the outer peripheral surface of the photoreceptor drum 201. Note that the present specification describes, as an example, a case of using a reversal development method for supplying toner charged to the same polarity as the charge potential in the unexposed region of the photoreceptor drum 201 and depositing the toner to the exposed region. However, it is obvious that a charged area development method may be used in which toner charged to a polarity opposite to the charge potential in the unexposed region is supplied and the toner is deposited to the unexposed region.

Figure 3:
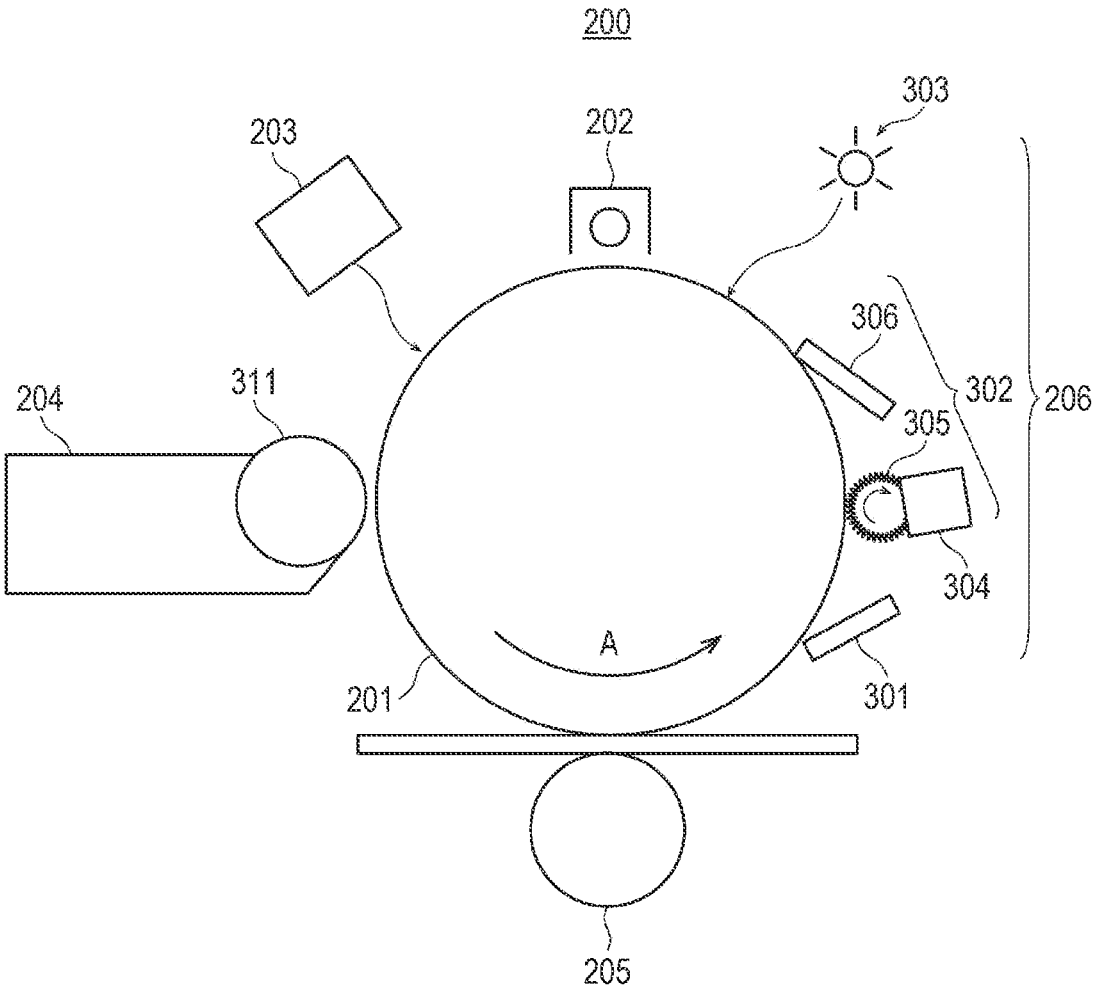
FIG. 3 is a diagram illustrating a main configuration of an image forming unit included in the image former.

The developing device 204 includes a development sleeve 311 disposed so as to face the photoreceptor drum 201 with a development region interposed therebetween as illustrated in, for example, FIG. 3. The development sleeve 311 is applied with, for example, a DC development bias having the same polarity as the charge polarity by the charging device 202 or a development bias in which a DC voltage having the same polarity as the charge polarity by the charging device 202 is superimposed on an AC voltage. Due to this development bias, reversal development is performed in which the toner is attracted to the exposed region of the outer peripheral surface of the photoreceptor drum 201.

The developing device 204 develops the electrostatic latent image using a two-component developer including toner and a carrier.

The toner is not particularly limited, and known commonly used toner can be used. Known commonly used toner is obtained, for example, by adding a colorant and, if necessary, a charge control agent, a release agent, or the like to a binder resin and treating the binder resin with an external additive.

As the external additive, a metal oxide microparticle such as silica or titania is used, and particles having a small particle diameter of 30 nm or a relatively large particle diameter of 100 nm or the like can be used. The toner particle size is not limited thereto, but is preferably about 3 to 15 μm.

The carrier is a component for charging the toner. The carrier is not particularly limited, and a known commonly used carrier can be used. Known commonly used carriers are, for example, binder carriers, coated carriers, and the like. The carrier particle size is not limited thereto, but is preferably 15 to 100 μm.

(2-5) Primary Transfer Roller 205

The primary transfer roller 205 is pressed against the photoreceptor drum 201 with an intermediate transfer belt 211 interposed therebetween. When a primary transfer bias voltage is applied between the primary transfer roller 205 and the photoreceptor drum 201, the toner image carried on the outer peripheral surface of the photoreceptor drum 201 is electrostatically transferred onto the outer peripheral surface of the intermediate transfer belt 211 (primary transfer). The primary transfer bias voltage is usually opposite in polarity to the toner.

(2-6) Cleaning Device 206

The cleaning device 206 removes charges remaining on the outer peripheral surface of the photoreceptor drum 201 after the primary transfer, or scrapes and discards toner remaining on the outer peripheral surface. As illustrated in FIG. 3, the cleaning device 206 includes a cleaning blade 301, a lubricant application mechanism 302, and an eraser 303. The cleaning blade 301 scrapes off and discards the toner remaining on the outer peripheral surface of the photoreceptor drum 201 (blade cleaning method).

(2-6-1) Cleaning Blade 301

The cleaning blade 301 is a flat elastic member. As the physical properties of the cleaning blade, the impact resilience and hardness are significant. The impact resilience is preferably 10 to 80% and more preferably 30 to 70%, at a temperature of 25° C. In addition, the JIS A hardness is preferably 20 to 90°, and more preferably 60 to 80°.

When the JIS A hardness is less than 20°, the cleaning blade is too soft, so that the blade is easily turned over. On the other hand, when the JIS A hardness is greater than 90°, the cleaning blade is difficult to follow slight irregularities of and foreign matters on the photoreceptor, so that a failure in cleaning toner particles is likely to occur.

(2-6-2) Lubricant Application Mechanism 302

The lubricant application mechanism 302 includes a lubricant 304, a brush 305, and a leveling blade 306. The lubricant 304 is applied to reduce wear of the outer peripheral surface of the photoreceptor drum 201 by reducing friction between the outer peripheral surface of the photoreceptor drum 201 and the cleaning blade 301.

The brush 305 scrapes off the lubricant 304 while rotating in the same direction as the photoreceptor drum 201, and applies the lubricant 304 to the outer peripheral surface of the photoreceptor drum 201. It is obvious that an application member for applying the lubricant 304 to the outer peripheral surface of the photoreceptor drum 201 is not limited to the brush 305, and an application member other than the brush 305, such as a sponge, may be used.

The lubricant 304 is a solid lubricant formed in a bar shape, and is pressed against the brush 305 using a spring (not illustrated). In the present embodiment, a case where zinc stearate is used as the lubricant 304 is described as an example. However it is obvious that the lubricant 304 is not limited to zinc stearate, and a fatty acid metal salt, silicone oil, fluorine-based resin, and the like can be used.

These lubricants may be used alone, or may be used in combination of two or more thereof. Among the lubricants described above, a fatty acid metal salt is particularly preferable. As the fatty acid in the fatty acid metal salt, a linear hydrocarbon is preferable, and for example, myristic acid, palmitic acid, stearic acid, oleic acid and the like are preferable. Among others, stearic acid is more preferable.

As the metal, lithium, magnesium, calcium, strontium, zinc, cadmium, aluminum, cerium, titanium, iron, and the like can be used. Among others, zinc stearate, magnesium stearate, aluminum stearate, iron stearate, and the like are preferable, and in particular, zinc stearate is most preferable.

FIG. 3 illustrates a case where the lubricant application mechanism 302 is disposed on the downstream side of the cleaning blade 301 in the rotation direction of the photoreceptor drum 201. However, the present disclosure is obviously not limited thereto, and the lubricant application mechanism 302 may be disposed on the upstream side of the cleaning blade 301. Further, the effect of the present disclosure can be obtained even if the lubricant application mechanism 302 is omitted from the image forming unit 200.

The leveling blade 306 levels the lubricant applied onto the outer peripheral surface of the photoreceptor drum 201 so that the thickness of the lubricant is uniform Similar to the cleaning blade 301, an elastic member is preferably used as the leveling blade.

(2-6-3) Eraser 303

The eraser 303 exposes the outer peripheral surface of the photoreceptor drum 201 to electrically conduct the entire surface, thereby removing electric charges remaining on the outer peripheral surface. As the eraser 303, a light source such as a light emitting diode (LED) can be used. After being neutralized by the eraser 303, the photoreceptor drum 201 is charged again by the charging device 202 to enable formation of a next electrostatic latent image.

The image forming units 200Y, 200M, 200C, and 200K primarily transfer the toner images at the same timing so that the toner images of the respective colors of Y, M, C, and K overlap each other on the outer peripheral surface of the intermediate transfer belt 211. Thus, a color toner image is formed.

The intermediate transfer belt 211 is an endless belt, is wound around a secondary transfer roller pair 212 and rollers 213 and 214, and circulates in a direction of an arrow B. As a result, the toner image carried on the outer peripheral surface of the intermediate transfer belt 211 is conveyed to a secondary transfer nip of the secondary transfer roller pair 212.

The secondary transfer roller pair 212 includes a pair of rollers to which a secondary transfer bias voltage is applied. The pair of rollers is pressed against each other with the intermediate transfer belt 211 interposed therebetween to form a secondary transfer nip. The recording sheet S is conveyed from the sheet feeder 110 in the direction of an arrow C at the timing at which the toner image carried on the outer peripheral surface of the intermediate transfer belt 211 is conveyed to the secondary transfer nip.

As a result, the toner image is electrostatically transferred from the outer peripheral surface of the intermediate transfer belt 211 to an image forming surface of the recording sheet S (secondary transfer). The fixing device 215 heats and melts the toner image carried on the recording sheet S, and presses the toner image on the image forming surface of the recording sheet S (heat fixing).

A scanner device 216 reads an image formed on the image forming surface of the recording sheet S, generates image data, and transmits the image data to the controller 101. As the scanner device 216, for example, a line-type charge coupled device (CCD) image sensor that reads the recording sheet S conveyed from the fixing device 215 to the sheet exit tray 102 can be used. In place of the CCD, a line scanner such as a contact image sensor (CIS) can also be used.

The recording sheet S from which the image on the image forming surface has been read is ejected onto the sheet exit tray 102. In a case of forming a plurality of images, the recording sheets S are sequentially stacked on the sheet exit tray 102.

[3] Ozone Blur (Linear Blur) Locally Generated in Main Scanning Direction

Ozone blur is a phenomenon that occurs when a discharge product such as ozone or nitrogen oxides (NOx) generated during the charging step adheres onto the outer peripheral surface of the photoreceptor drum 201 and further absorbs moisture to be reduced in resistance.

Figure 7A:
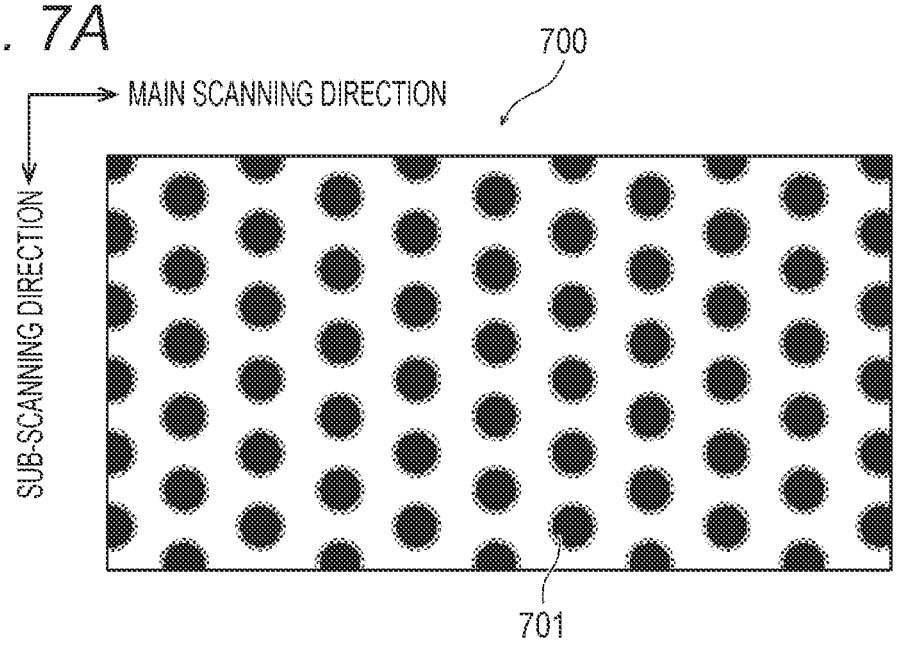
FIG. 7A illustrates a test image of a dot half pattern.
Figure 7B:
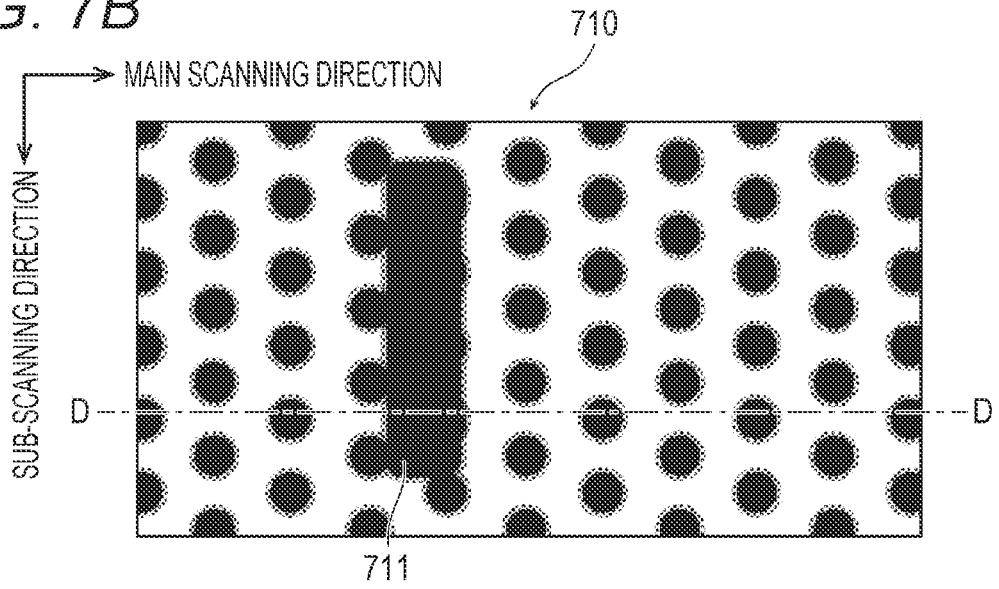
FIG. 7B illustrates a test image of a dot half pattern having a linear blur.

When the ozone blur occurs, the electrification charge on the outer peripheral surface of the photoreceptor drum 201 is dispersed from the unexposed region to the exposed region via the discharge product having a reduced resistance, so that grayscale abnormality occurs, and image noise in which an image is blurred is visually recognized. For example, in a dot half pattern, image noise in which dots are connected appears as illustrated in FIG. 7B, and in a line image, image noise in which a line is extended appears as illustrated in FIG. 9B.

When the image forming processing is executed, the discharge product is generated from the charging device 202. When a long period of time elapses after the execution of the image forming processing while the rotation of the photoreceptor drum 201 is stopped without the execution of the next image forming processing, etc., a specific region of the outer peripheral surface of the photoreceptor drum 201 in the circumferential direction continues to face the charging device 202, so that the discharge product continues to adhere and accumulate.

Therefore, ozone blur is particularly noticeable. Such ozone blur appears at a rotation period (circumferential length pitch) of the photoreceptor drum 201. In addition, since the charging device 202 faces the outer peripheral surface of the photoreceptor drum 201 over the entire width in the axial direction of the photoreceptor drum 201, ozone blur appears on the image over the entire width in the main scanning direction.

When removing the residual toner from the outer peripheral surface of the photoreceptor drum 201, the cleaning blade 301 cleans the outer peripheral surface of the photoreceptor drum 201 over the entire width in the axial direction of the photoreceptor drum 201. For this reason, in the conventional technique, the discharge product adhering over the entire width in the axial direction (main scanning direction) of the photoreceptor drum 201 is also removed using the cleaning blade 301.

However, as a result of an investigation conducted by the inventors in order to achieve high definition image quality for commercial use which has been demanded in recent years in the printing industry, it is found that there is ozone blur locally generated in the main scanning direction in addition to ozone blur that appears over the entire width in the main scanning direction which has been conventionally known. Such ozone blur is discovered for the first time when high-definition printing for commercial use has been required.

The ozone blur locally generated in the main scanning direction is a fine linear gray scale abnormality in the circumferential direction of the photoreceptor drum 201 when observed in detail. Therefore, this ozone blur is hereinafter referred to as "linear blur".

The linear blur is considered to be generated in such a manner that a discharge product enters a fine damaged portion generated on the outer peripheral surface of the photoreceptor drum 201 due to sliding contact with a member such as the cleaning blade 301 or the brush 305 during rotation of the photoreceptor drum 201, and this discharge product absorbs moisture and is reduced in resistance.

It is presumed that the cleaning force by the cleaning blade 301 does not sufficiently act on the discharge product that has entered the fine damaged portion generated on the outer peripheral surface of the photoreceptor drum 201, and it takes a long time to remove the discharge product by using an ordinary material as the cleaning blade 301. On the other hand, when the cleaning blade 301 having a high cleaning force is used, wear of the photoreceptor drum 201 is accelerated, and the life may be shortened.

In view of this, in the present embodiment, the outer peripheral surface of the photoreceptor drum 201 is intensively cleaned only when linear blur is detected, by which high definition image quality is achieved with wear of the photoreceptor drum 201 being reduced.

[4] Configuration of Controller 101

Next, the configuration of the controller 101 will be described.

Figure 4:
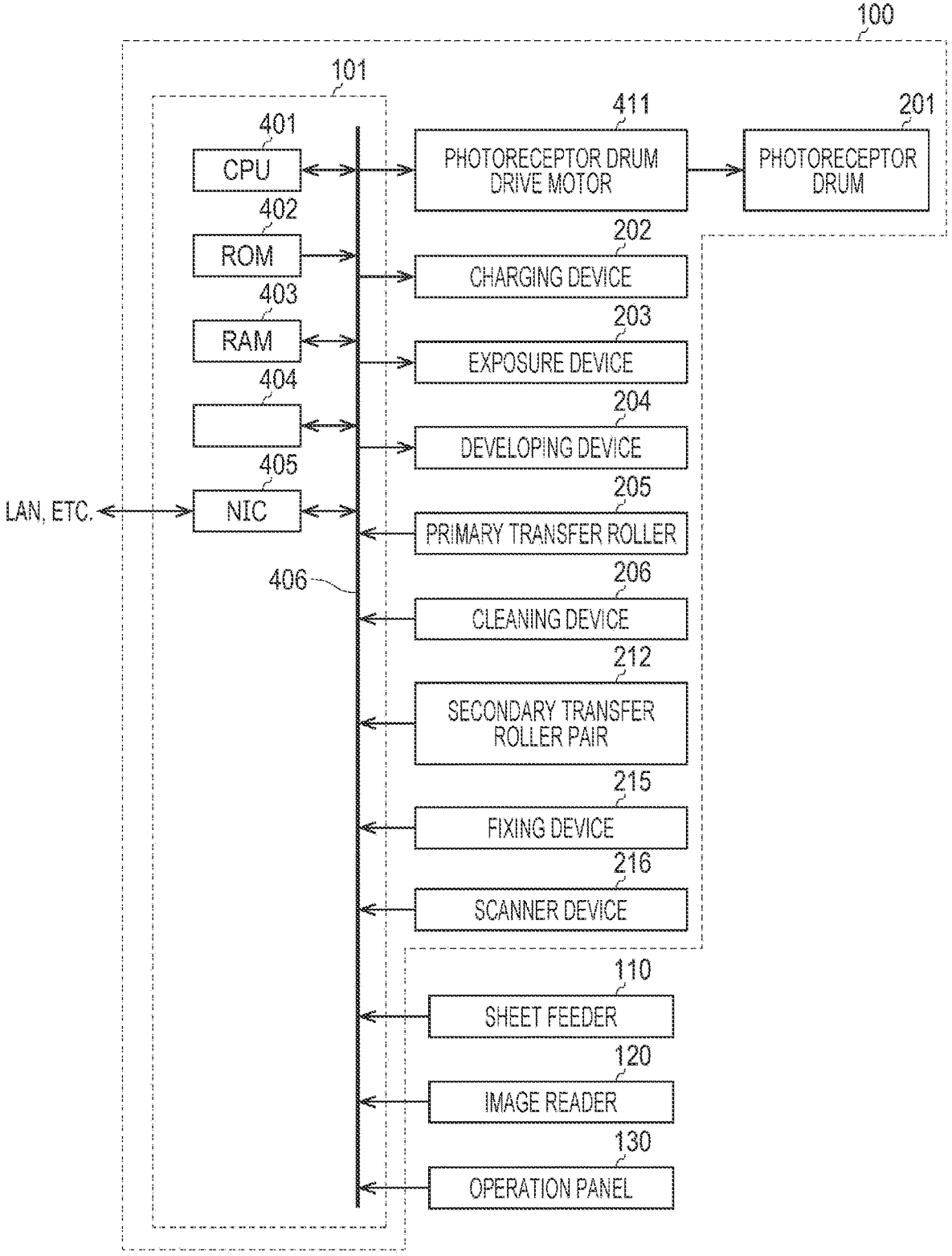
FIG. 4 is a block diagram illustrating a main configuration of a controller included in the image former.

As illustrated in FIG. 4, the controller 101 includes a central processing unit (CPU) 401, a read only memory (ROM) 402, a random access memory (RAM) 403, and the like which are connected by an internal bus 406 so as to be able to communicate with one another.

When the image forming apparatus 1 is powered on and reset, the CPU 401 reads and activates a boot program from the ROM 402, and reads and executes an operating system (OS) and a control program from a hard disk drive (HDD) 404 using the RAM 403 as a working memory area.

A network interface card (NIC) 405 executes processing for communicating with an external device such as a personal computer via a communication network such as a local area network (LAN) or the Internet. As a result, an image forming job can be received from the external device.

The controller 101 controls the photoreceptor drum drive motor 411 to rotationally drive the photoreceptor drum 201. The controller 101 further controls the charging device 202, the exposure device 203, the developing device 204, the primary transfer roller 205, the cleaning device 206, the secondary transfer roller pair 207, the fixing device 215, the sheet feeder 110, and the image reader 120 to execute the image forming processing.

In addition, when linear blur is detected, the scanner device 216 is further controlled so that the image formed on the recording sheet S is read on the conveyance path of the recording sheet S from the fixing device 215 to the sheet exit tray 102.

[5] Operation of Controller 101

Next, the operation of the controller 101 will be described.

Figure 5:
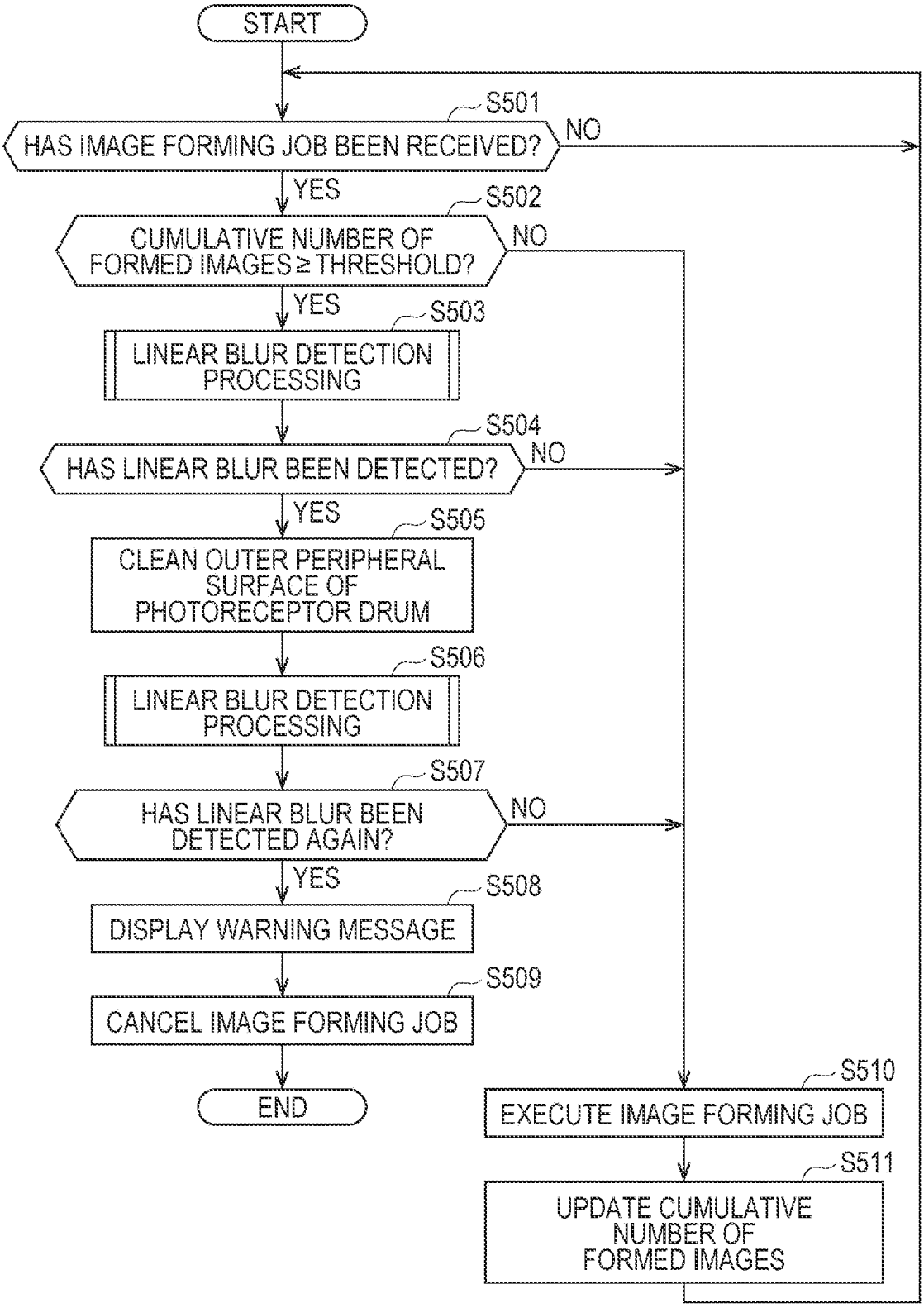
FIG. 5 is a flowchart illustrating processing executed by the controller in order to eliminate linear blur.

As illustrated in FIG. 5, when receiving the image forming job (S501: YES), the controller 101 checks whether or not the cumulative number of formed images is equal to or larger than a threshold for each of the image forming units 200Y, 200M, 200C, and 200K.

When there is no image forming unit 200 in which the cumulative number of formed images is equal to or larger than the threshold as a result of the checking process (S502: NO), the controller 101 performs the image forming job (S510), updates the cumulative number of formed images by adding the number of images formed in the image forming job for each color of YMCK to the cumulative number of formed images (S511), and then, proceeds to step S501 and waits for the next image forming job.

In a case where there is one or a plurality of image forming units 200 in which the cumulative number of formed images is equal to or larger than the threshold, linear blur detection processing is executed for the image forming unit 200 in which the cumulative number of formed images is equal to or larger than the threshold (S503). The details of the linear blur detection processing will be described later.

The reason why the linear blur detection processing is executed only for the image forming unit 200 in which the cumulative number of formed images is equal to or larger than the threshold is that the linear blur is likely to appear after the photoreceptor drum 201 is aging and the number of fine damaged portions increases on the outer peripheral surface of the photoreceptor drum 201. Relatively, in an initial state, the photoreceptor drum 201 has no damaged portion on the outer peripheral surface, and it is highly likely that the linear blur does not occur. Therefore, it may not be necessary to execute the linear blur detection processing.

In addition, as described later, a test image is formed in the linear blur detection processing. Therefore, if the linear blur detection processing is not executed for the image forming unit 200 in which the cumulative number of formed images is small, the toner of the color for the image forming unit is not unnecessarily consumed.

However, it is needless to say that, in terms of the purpose of detecting the linear blur, the linear blur detection processing may be executed for all the image forming units 200 regardless of the number of cumulative formed images.

When the linear blur is detected as a result of executing the linear blur detection processing, the outer peripheral surface of the photoreceptor drum 201 is cleaned in a recovery mode (S505). During cleaning, the photoreceptor drum 201 is rotated a predetermined number of times, and the outer peripheral surface is rubbed by the cleaning blade 301 to scrape off the discharge product adhering to the outer peripheral surface.

In the recovery mode, the photoreceptor drum 201 may be rotated while the toner is supplied from the developing device 204. With this configuration, the toner can act as an abrasive when the outer peripheral surface of the photoreceptor drum 201 is brought into sliding contact with the cleaning blade 301, whereby the discharge product adhering to the outer peripheral surface can be effectively removed.

The number of rotations of the photoreceptor drum 201 is desirably set to a value by which the discharge product that has entered the damaged portion of the outer peripheral surface can be sufficiently removed. However, the more the number of rotations increases, the more the photoreceptor drum 201 wears. Therefore, an appropriate number of rotations should be determined by experiments or the like.

After the cleaning, the linear blur detection processing is executed again (S506). The linear blur detection processing in step S506 may be executed only for the image forming unit 200 in which the linear blur is detected in the linear blur detection processing in step S503.

As a result of executing the linear blur detection processing in step S506, when the linear blur is detected again in the image forming unit 200 in which the linear blur has been detected in the linear blur detection processing in step S503 (S507: YES), the controller 101 displays a warning message on the operation panel 130 (S508).

This is because the linear blur cannot be eliminated even if the outer peripheral surface of the photoreceptor drum 201 is cleaned, and high-definition printing for commercial use cannot be performed, and thus the photoreceptor drum 201 or the image forming unit 200 including the photoreceptor drum 201 needs to be replaced.

For the same reason, the image forming job is canceled (S509), and the processing is ended. This is because, even if the image forming job is executed, linear blur occurs, and a high-definition image cannot be formed.

When the linear blur is not detected in the linear blur detection processing of step S503, the image forming job is executed (S510), the number of images of each color of YMCK formed in the image forming job is added to the cumulative number of formed images corresponding to the color (S511), and then the controller 101 proceeds to step S501 and waits for the next image forming job.

In addition, when it is confirmed that, even if the linear blur is detected in the linear blur detection processing in step S503, the discharge product is removed from the outer peripheral surface of the photoreceptor drum 201 by the cleaning process in step S505 and the linear blur is eliminated (S507: NO), the controller 101 executes the image forming job (S510), updates the cumulative number of formed images (S511), and then, proceeds to step S501 and waits for the next image forming job as in the above-mentioned case.

With this configuration, only when linear blur is detected, the photoreceptor drum 201 is cleaned to remove the discharge product causing the linear blur from the outer peripheral surface of the photoreceptor drum. Thus, unnecessary wear of the photoreceptor drum 201 can be reduced as compared with a case where the cleaning is executed regardless of the occurrence of the linear blur. Therefore, the life of the photoreceptor drum 201 can be prolonged.

[6] Linear Blur Detection Processing

Next, the linear blur detection processing executed in steps S503 and S506 will be described.

The linear blur detection processing is for detecting linear blur. The linear blur has the features that:

(a) the linear blur is image noise caused by the discharge product that has entered the damaged portion generated on the outer peripheral surface of the photoreceptor drum 201, and the rubbing force by the cleaning blade 301 is less likely to act thereon, and thus, it takes time to eliminate the linear blur as compared with normal ozone blur;

(b) for the same reason, the linear blur is repeatedly generated at a specific position in the main scanning direction at the circumferential length pitch of the photoreceptor drum;

(c) the linear blur does not have a specific tendency regarding which position in the main scanning direction is the specific position; and (d) the damaged portion generated by sliding contact between the outer peripheral surface of the photoreceptor drum 201 and the cleaning blade 301 or the like is linear in the circumferential direction of the photoreceptor drum 201, and thus, is linear in the sub-scanning direction. Therefore, focusing on the above features, the linear blur can be detected.

Figure 6:
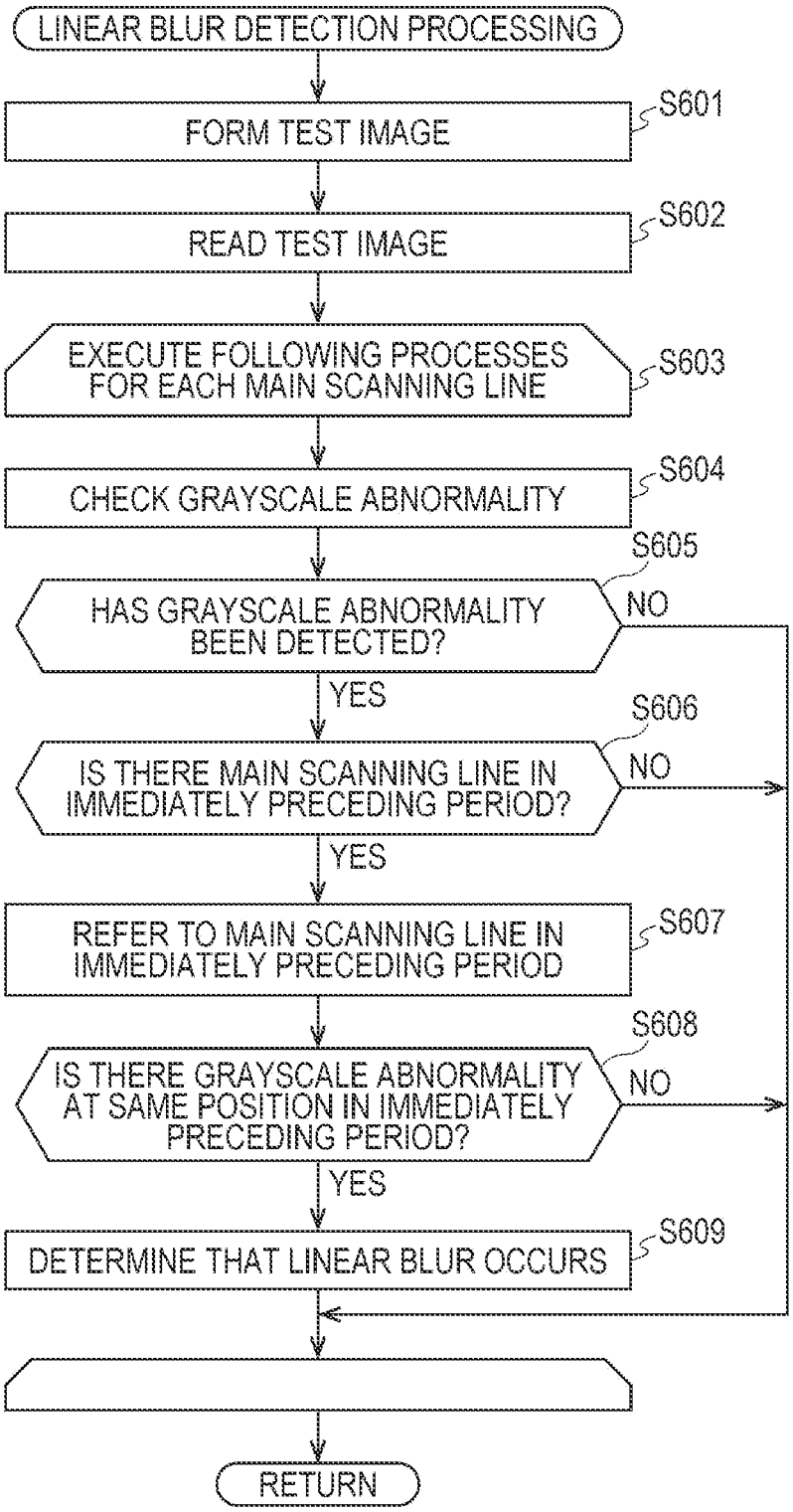
FIG. 6 is a flowchart for describing a flow of linear blur detection processing.

In the linear blur detection processing, the controller 101 first forms a test image as illustrated in FIG. 6 (S601).

In the present embodiment, an image of a dot half pattern is formed as the test image. As illustrated in FIG. 7A, a dot half pattern 700 is an image in which a halftone is expressed by the dot pattern. In the present embodiment, the case of using the reversal development method is described as an example. Therefore, a dot 701 is drawn by the toner adhering to the region where the electrification charge is lost on the outer peripheral surface of the photoreceptor drum 201 by the exposure, and the unexposed region is a white portion to which the toner does not adhere.

When the dot half pattern is formed using the photoreceptor drum 201 which has an outer peripheral surface damaged due to sliding contact with the cleaning blade 301 or the like and which has a discharge product entering the damaged portion, a linear blur 711 extending along the sub-scanning direction occurs at a position corresponding to the damaged portion in the dot half pattern 710 as illustrated in FIG. 7B.

In the present embodiment, the discharge product that has entered the damaged portion of the outer peripheral surface of the photoreceptor drum 201 and has reduced electric resistance due to moisture electrically connects the unexposed region and the exposed region which are near the discharge product on the outer peripheral surface of photoreceptor drum 201, thereby reducing the electrification charges of the unexposed region. As a result, electrification charges are lost at the damaged portion and in the vicinity thereof, so that toner adheres during development. Thus, the linear blur 711 occurs.

In order to detect the linear blur 711, the dot half pattern 710 needs to have a size equal to or larger than a length corresponding to two periods of the circumferential length pitch of the photoreceptor drum 201 in the sub-scanning direction in order to check the periodicity of the photoreceptor drum 201 in the circumferential direction (sub-scanning direction). In addition, it is necessary to continuously measure the density in the main scanning direction. The present embodiment enables the measurement of density by scanning an image which has been fixed on a sheet with a CCD (or CID).

In addition, as the size of the dot 701 in the dot half pattern 710 is reduced and the interval between the dots 701 is narrowed according to the size of the dot 701, the fine linear blur 711 can be detected, which is effective in ensuring high definition image quality.

The toner image of the dot half pattern formed on the outer peripheral surface of the photoreceptor drum 201 is transferred to the recording sheet S and fixed in the same manner as in normal image formation. When executing the linear blur detection processing, the controller 101 reads, line by line, the image formed on the recording sheet S with the scanner device 216 (S602). Due to this reading process, image data (hereinafter simply referred to as a "test image") obtained by reading the test image is generated.

The controller 101 executes loop processing from step S603 to step S610 for each main scanning line of the test image. That is, a difference value (density profile) obtained by subtracting a pixel value of the original test image from a pixel value of the read test image is obtained for each pixel of the main scanning line, the difference value is compared with a threshold Th, and a grayscale abnormality is checked on the basis of whether or not there is a portion exceeding the threshold Th (S604).

Figure 7C:
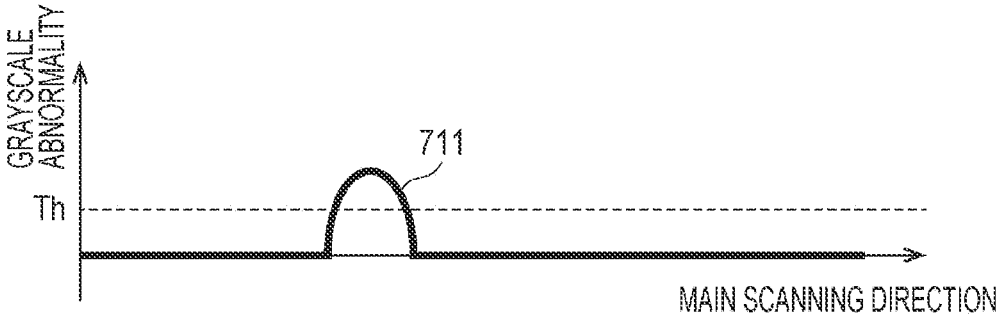
FIG. 7C illustrates a density abnormality profile taken along line D-D in FIG. 7B.

FIG. 7C is a graph illustrating a grayscale abnormality (difference value) in the main scanning line (D-D line) crossing the linear blur 711 in the dot half pattern 710 having the linear blur 711. In this graph, a grayscale abnormality appears at a position corresponding to the linear blur 711. A white background region in the original test image is no longer a white background due to the linear blur 711, and thus, the grayscale abnormality occurs.

When the grayscale abnormality has been detected from the comparison between the difference value and the threshold (S605: YES), the controller 101 checks whether or not there is a main scanning line in the immediately preceding period with respect to the current main scanning line at the circumferential length pitch of the photoreceptor drum 201 in the test image. At the beginning of the loop processing, there is no main scanning line in the immediately preceding period with respect to the current scanning line.

When there is a main scanning line in the immediately preceding period (S606: YES), the controller 101 refers to the main scanning line in the immediately preceding period at the circumferential length pitch of the photoreceptor drum 201 in the test image (S607), and checks whether or not the grayscale abnormality has also been detected for the main scanning line in the immediately preceding period at the same position as the position where the grayscale abnormality has been detected for the current main scanning line.

When the grayscale abnormality for the main scanning line in the immediately preceding period is detected at the same position as the position where the grayscale abnormality for the current main scanning line is detected (S608: YES), it is determined that linear blur occurs (S609). Note that, regarding the position of the grayscale abnormality in the main scanning direction, it is desirable to determine that the positions of the grayscale abnormality are the same if the positions are close to each other within a certain error range in consideration of a possibility of positional deviation or the like due to skew of the recording sheet S.

In addition, an upper limit value of a distance (for example, the number of pixels) at which a portion where the difference value exceeds the threshold Th continues in the main scanning direction may be set, and when the distance exceeds the upper limit value, in other words, when there is no local grayscale abnormality in the main scanning direction, it may be determined that no linear blur occurs.

However, even if the linear blur is not generated, there is a possibility that the discharge product adheres to the relevant portion on the outer peripheral surface of the photoreceptor drum 201 and generates ozone blur, and thus, it is effective to apply the recovery mode in order to eliminate such ozone blur.

Figure 8A:
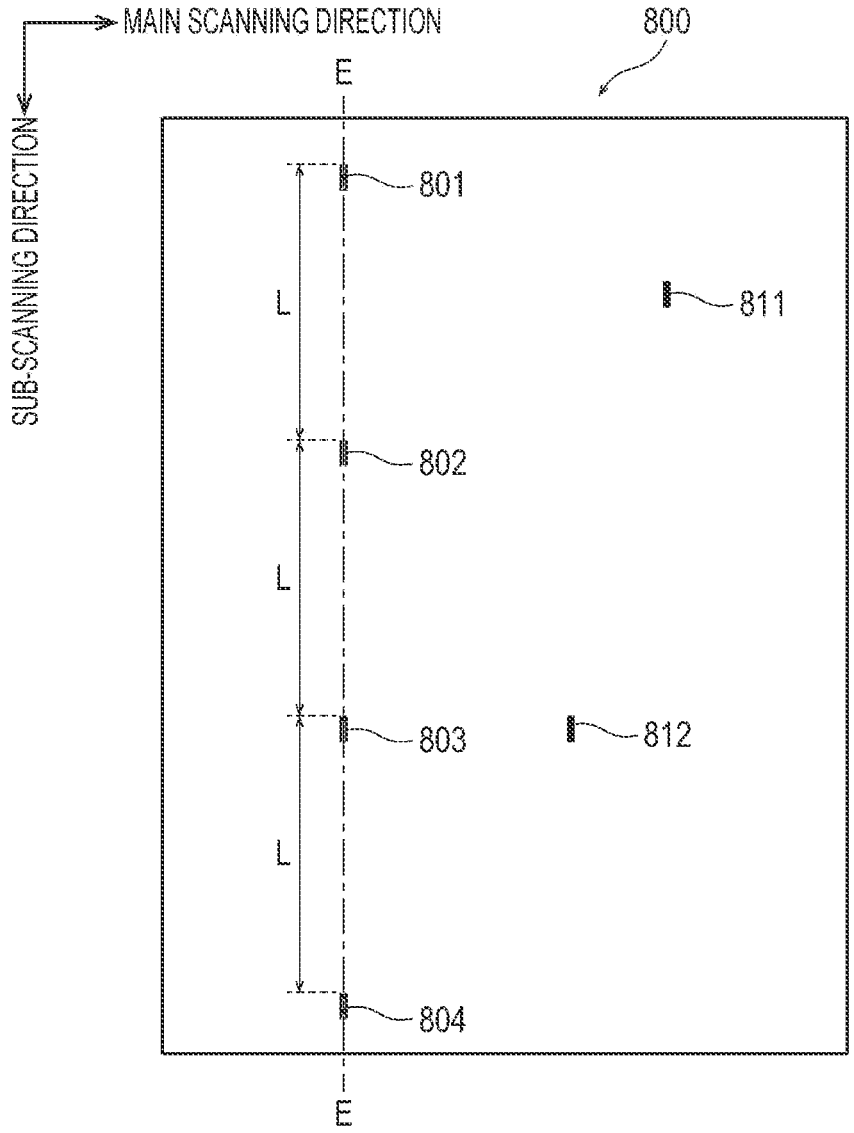
FIG. 8A illustrates grayscale abnormalities having periodicity in a sub-scanning direction and grayscale abnormalities having no periodicity.
Figure 8B:
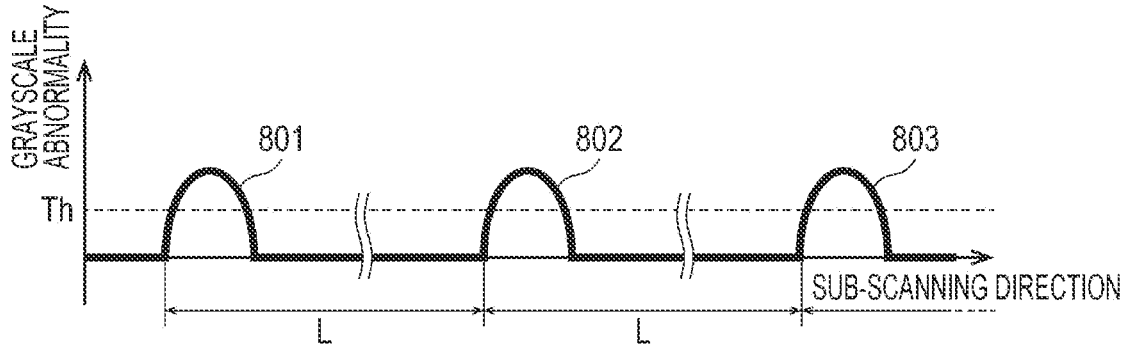
FIG. 8B illustrates a density abnormality profile taken along line E-E in FIG. 8A.

In a profile image of the grayscale abnormality illustrated in FIG. 8A, grayscale abnormalities 801, 802, 803, and 804 periodically appear at the same position in the main scanning direction at a circumferential length pitch L of the photoreceptor drum 201. It can be confirmed that, also in the profile of the grayscale abnormality along line E-E passing through the position in the main scanning direction, the portions where the grayscale abnormality (difference value) exceeds the threshold Th periodically appear corresponding to the grayscale abnormalities 801, 802, and 803 in the sub-scanning direction at the circumferential length pitch L of the photoreceptor drum 201, as illustrated in FIG. 8B.

Therefore, it can be determined that linear blur has occurred from the grayscale abnormalities 801, 802, 803, and 804. On the other hand, both grayscale abnormalities 811 and 812 do not periodically appear in the sub-scanning direction, and thus do not contribute to the determination regarding the occurrence of the linear blur.

When the grayscale abnormality has not been detected for the current main scanning line (S605: NO), when there is no main scanning line in the immediately preceding period (S606: NO), when the grayscale abnormality has not been detected for the main scanning line in the immediately preceding period (S608: NO), and when the position where the grayscale abnormality for the current main scanning line has been detected is different from the position where the grayscale abnormality for the main scanning line in the immediately preceding period has been detected (S609: NO), the controller 101 performs the processing for the next main scanning line while maintaining the determination regarding the occurrence of the linear blur.

Thereafter, when the loop processing is completed, the controller 101 returns to the upper routine. The controller 101 may end the loop processing and return to the upper routine at the timing at which the linear blur is determined to occur. This is because, in the upper routine, when at least one linear blur is detected, the outer peripheral surface of the photoreceptor drum 201 is cleaned regardless of the number of detected linear blurs (S505).

With this configuration, it is possible to accurately detect the linear blur caused by the discharge product entering the damaged portion generated on the outer peripheral surface of the photoreceptor drum 201.

[7] Modification

While the present disclosure has been described above based on the embodiment, it is obvious that the present disclosure is not limited to the embodiment described above, and the following modifications are also possible.

(7-1) In the above embodiment, the case where the test image is a dot half pattern is described as an example. However, the present disclosure is obviously not limited thereto, and a test image other than the dot half pattern may be used.

For example, a thin line pattern may be used as the test image. In this case, in a thin line pattern 900 illustrated in FIG. 9A, thin lines 901 extending in the main scanning direction are repeatedly drawn at equal intervals in the sub-scanning direction.

When the linear blur 911 is generated in the thin line pattern 900, the line width of the thin line is widened at the portion where the linear blur is generated as illustrated in FIG. 9B, because the linear blur is caused by the discharge product entering the damaged portion extending in the sub-scanning direction (the circumferential direction of the photoreceptor drum 201).

Figure 9A:
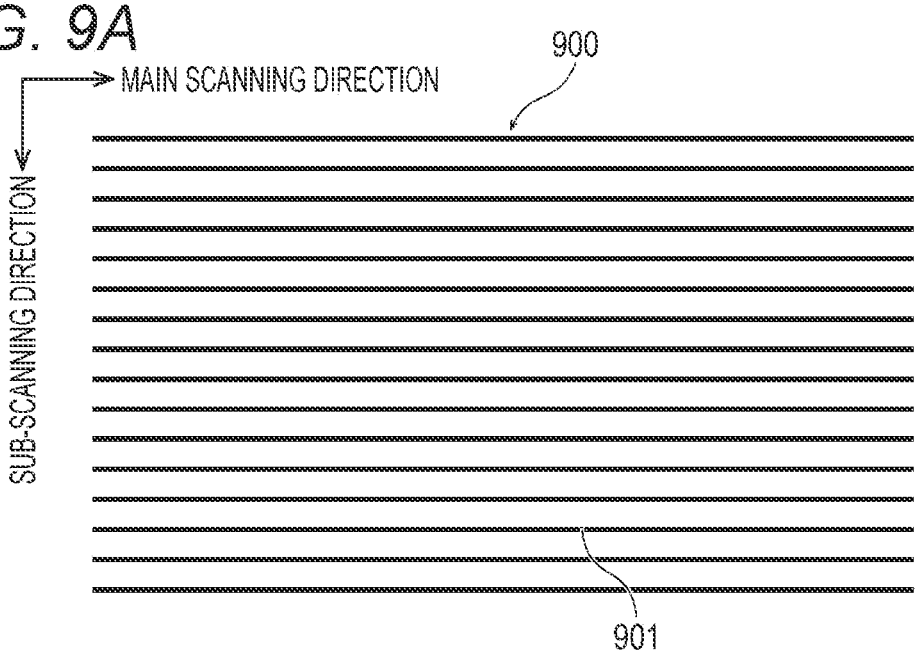
FIG. 9A illustrates a test image of a thin line pattern.
Figure 9B:
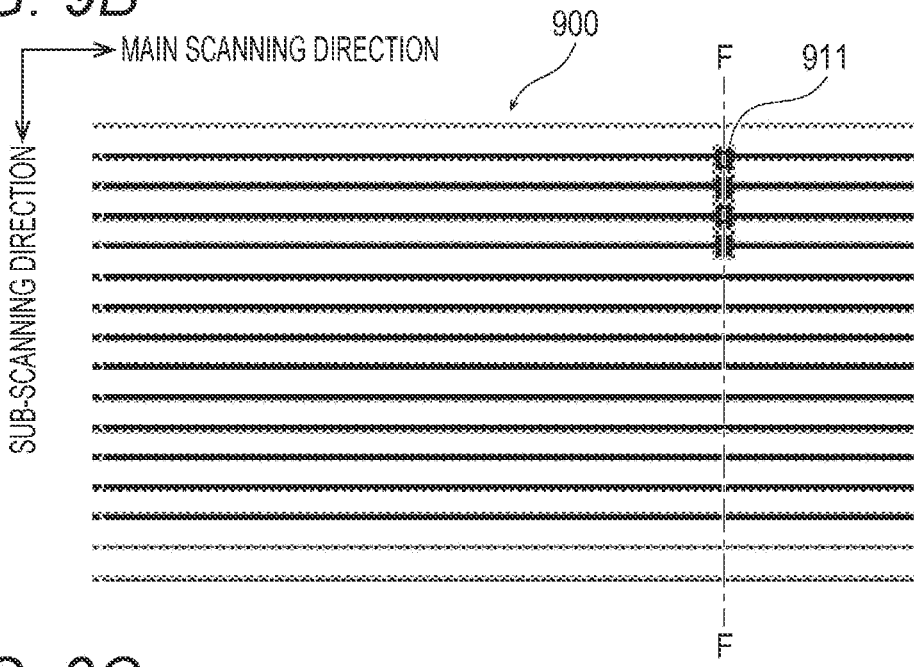
FIG. 9B illustrates a test image of a thin line pattern having a linear blur.
Figure 9C:
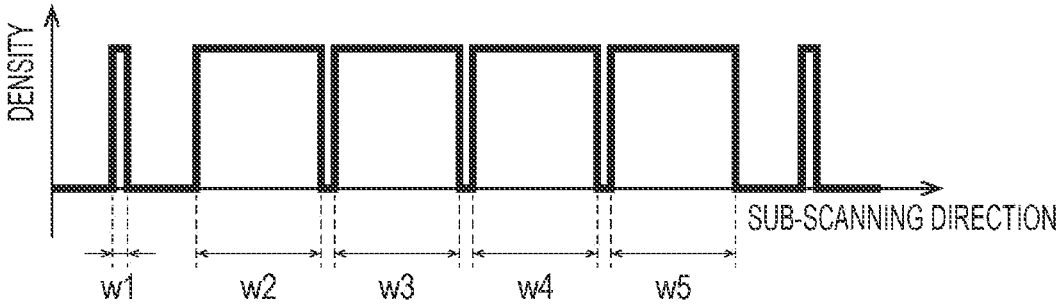
FIG. 9C illustrates a density profile taken along line F-F in FIG. 9B.

For this reason, in the linear blur detection processing of detecting the linear blur using the thin line pattern, the occurrence of the linear blur 911 can be determined based on whether or not the portion where the thin line 901 which originally has a line width of w1 has a line width of w2, w3, w4, or w5 larger than the predetermined threshold Th periodically and repeatedly appears in the density profile at the circumferential length pitch L of the photoreceptor drum 201 as illustrated in FIG. 9C by sequentially referring to the sub-scanning lines of the test image read by the scanner device 216.

Using the thin line pattern 900 as the test image can provide an advantage that the amount of toner used to form the test image is small.

When the thin line pattern 900 is used as the test image, the thin line 901 does not pass through a constant position in the linear blur in the sub-scanning direction unless the cycle (sum of the line width and the interval) of the thin line 901 in the sub-scanning direction is an integral submultiple of the circumferential length pitch L of the photoreceptor drum 201, and thus, it may not be possible to detect the periodicity of the linear blur.

On the other hand, when the cycle of the thin line 901 in the sub-scanning direction is set to an integral submultiple of the circumferential length pitch L of the photoreceptor drum 201, the positional relationship between the linear blur and the thin line 901 can be kept constant, so that the detection accuracy of the linear blur can be improved.

In addition, when the thin line pattern 900 is used, linear blur having a length shorter than the cycle of the thin line 901 in the sub-scanning direction may not be detected. Therefore, when it is desired to achieve high definition image quality, it is desirable to use the thin line pattern 900 in which the cycle of the thin line 901 is smaller than the allowable length of the linear blur in the sub-scanning direction.

FIG. 9A illustrates the thin line pattern 900 in which the thin line 901 extends in the main scanning direction. However, the occurrence of the linear blur can be determined based on whether or not a portion where the thin line 901 has an increased line width in the sub-scanning direction periodically appears at the circumferential length pitch L of the photoreceptor drum 201, as long as the thin line 901 extends in a direction other than the sub-scanning direction.

In the case where the thin line pattern 900 is used as the test image, the upper limit value of the distance (for example, the number of pixels) in which the portion where the line width of the thin line 901 is increased is continuous in the main scanning direction may be set, and it may be determined that the linear blur does not occur when the distance exceeds the upper limit value, as in the case of using a dot half pattern as the test image.

In this case, there is also a possibility that ozone blur other than linear blur occurs, and thus, it is effective to apply the recovery mode in order to eliminate the ozone blur.

As described above, even when the thin line pattern 900 is used as the test image, the linear blur can be detected. A test image other than the dot half pattern 700 and the thin line pattern 900 can be used for detecting the linear blur, as long as it is formed by an electrostatic latent image in which the exposed region and the unexposed region alternately appear in a period shorter than the length of the linear blur to be detected in the sub-scanning direction.

(7-2) In the above embodiment, the case where the linear blur is detected by reading the test image fixed on the recording sheet S using the scanner device 216 is described as an example.

The scanner device 216 is easily placed on the conveyance path of the recording sheet S from the fixing device 215 to the sheet exit tray 102 as in the above-described embodiment, because there is enough space.

Furthermore, the configuration of the present embodiment is also excellent in that the scanner device 216 is less likely to be contaminated when the linear blur is detected.

However, the present disclosure is obviously not limited thereto, and the following configuration may be applied instead.

For example, the linear blur may be detected on the outer peripheral surface of the photoreceptor drum 201. This configuration does not need to transfer or fix the test image to the recording sheet S, whereby power consumption for transfer and fixing and consumption of components can be suppressed, and the recording sheet S can be saved.

The linear blur may also be detected from the test image carried on the intermediate transfer belt 211. The linear blur may be detected on the circulating path of the intermediate transfer belt 211 from the image forming unit 200 (in FIG. 2, the image forming unit 200K) located most downstream in the circulating direction of the intermediate transfer belt 211 to the secondary transfer roller pair 212.

In addition, in a case where the linear blur is detected on the downstream side of the secondary transfer roller pair 212, it is desirable to stop the application of the secondary transfer bias voltage to the secondary transfer roller pair 212, apply a bias voltage having a polarity opposite to that of the secondary transfer bias voltage, or separate the secondary transfer roller pair 212.

With this configuration, it is possible to prevent the test image from being disturbed on the intermediate transfer belt 211 due to the influence of the secondary transfer bias applied to the secondary transfer roller pair 212, and thus, the linear blur can be detected more accurately.

In the case where the linear blur is detected on the outer peripheral surface of the photoreceptor drum 201 as described above, it is necessary to individually mount a detection device for each photoreceptor drum 201. On the other hand, when the linear blur is detected from the test image carried on the intermediate transfer belt 211, the linear blur can be detected using a common detection device regardless of which photoreceptor drum 201 is used to form the test image.

As described above, the number of detection devices for detecting the linear blur is reduced, whereby the cost and size of the image forming apparatus 1 can be reduced.

Note that the test image may not be formed over the entire width of the photoreceptor drum 201 or the intermediate transfer belt 211 in the main scanning direction. As long as the test image is formed over the entire effective image region, high definition image quality can be ensured. In addition, even if the test image is formed not in the entire effective image area but with a certain width, the linear blur can be detected with high accuracy.

(7-3) In the above embodiment, the case where the recovery mode is applied when the linear blur is detected is described as an example. However, the present disclosure is obviously not limited thereto. When image noise other than the linear blur is detected, an image noise elimination sequence for eliminating the image noise may be applied in addition to the recovery mode.

In addition, in a case where image noise other than the linear blur is detected together with the linear blur, and the detected image noise other than the linear blur can be eliminated by applying the recovery mode for the linear blur, only the recovery mode may be applied, and the image noise elimination sequence for eliminating the detected image noise other than the linear blur may be omitted. With this configuration, it is possible to reduce wear and tear of the photoreceptor drum 201 and other components as compared with a case where both the linear blur recovery mode and another image noise elimination sequence are applied.

(7-4) In the above embodiment, the case of checking whether or not the grayscale abnormality exceeds the threshold in the difference image between the original test image (dot half pattern) and the test image read by the scanner device 216 is described as an example. Besides, in the above modification, the case of checking whether or not the line width is larger than the threshold in order to determine the occurrence of the linear blur in the test image of the thin line pattern 900 is described as an example. However, the present disclosure is obviously not limited thereto, and the following configuration may be applied instead.

For example, the determination may be performed based on whether or not there is a place where the grayscale abnormality or the variation of the line width is equal to or larger than a threshold with respect to an average value of the grayscale abnormality or the line width in a region determined to have no linear blur.

Here, in order to determine whether or not the region has a linear blur, a histogram of grayscale abnormality or line width may be used. The linear blur does not occur in most regions of the test image, and thus, a region where the frequency of the grayscale abnormality or the line width is significantly high in the histogram of the grayscale abnormality or the line width is determined to be a region having no linear blur.

Therefore, it is possible to obtain an average value of the grayscale abnormality and the line width in the region determined to have no linear blur by obtaining an average value of the grayscale abnormality and the line width having a high frequency in the histogram.

In addition, when there is a grayscale abnormality or a line width having a relatively high frequency in the histogram, separately from a grayscale abnormality or a line width having a significantly high frequency, a grayscale abnormality or a line width by which the grayscale abnormalities or line widths having a relatively high frequency can be clearly distinguished from one another may be set as a threshold, and candidates for linear blur may be detected from the test image using the threshold. Among the linear blur candidates, linear blur that periodically appears at the circumferential length pitch L of the photoreceptor drum 201 in the sub-scanning direction is the linear blur that is needed to be obtained.

(7-5) In the above embodiment, the case described as an example is the one where, when the linear blur is detected (S504: YES), the recovery mode is applied (S505), and then the linear blur is further detected (S507: YES in FIG. 5), a warning message is displayed (S508) and the image forming job is canceled (S509). However, the present disclosure is obviously not limited thereto, and the following configuration may be applied instead.

For example, a cycle of detecting the linear blur and applying the recovery mode may be repeated twice or more. That is, the number of times of rotating the photoreceptor drum 201 to remove the discharge product in each recovery mode may be reduced, and the outer peripheral surface of the photoreceptor drum 201 may be cleaned while checking the state of eliminating the linear blur.

With this configuration, when the linear blur that can be eliminated with a small number of rotations of the photoreceptor drum 201 occurs, wear of the photoreceptor which is caused by unnecessarily rotating the photoreceptor drum 201 despite the elimination of the linear blur can be prevented.

In contrast, this configuration can prevent deterioration of convenience for the user of the image forming apparatus 1 caused by displaying the warning message or canceling the image forming job although the linear blur can be eliminated by increasing the number of rotations of the photoreceptor drum 201.

In a case where the linear blur is not eliminated even if the cycle of applying the recovery mode is repeated a predetermined number of times as described above, it may be determined that there is a damaged portion that cannot be recovered on the photoreceptor, and a warning message may be displayed or the image forming job may be canceled.

(7-6) In the above embodiment, the case where the linear blur detection processing is further performed (S506) following the recovery mode performed for eliminating the linear blur (S505 in FIG. 5) is described as an example. However, the present disclosure is obviously not limited thereto, and the following configuration may be applied instead.

For example, when the linear blur can be eliminated by reliably removing the discharge product by applying the recovery mode due to the reason that, for example, the number of rotations of the photoreceptor drum 201 in the recovery mode is very large, the image forming job may be executed as usual without performing the linear blur detection processing again after the recovery mode is executed.

This configuration can prevent an increase in first copy out time (FCOT) due to unnecessary execution of the linear blur detection processing despite the linear blur being reliably eliminated, and thus can prevent deterioration in convenience for the user.

(7-7) In the above embodiment, the case where the outer peripheral surface of the photoreceptor drum 201 is cleaned using the cleaning blade 301 is described as an example. However, the present disclosure is obviously not limited thereto, and another cleaning member other than the cleaning blade 301, such as a brush, may be used instead of the cleaning blade 301. In this case, a magnetic brush formed by the developing device 204 can also be used as the cleaning member.

In a case where a rotating member such as a rotating brush is used as the cleaning member, the rotating member may be rotated during the application of the recovery mode under a condition different from that during the execution of the image forming job. For example, the rubbing force against the outer peripheral surface of the photoreceptor drum 201 can be increased by setting the rotation speed to be higher than that during the execution of the image forming job, whereby the discharge product can be more reliably removed.

In addition, when only the rotating member that rubs the outer peripheral surface of the photoreceptor drum 201 having the linear blue detected thereon is rotated or the rotation speed thereof is increased, the photoreceptor drum 201 having no linear blur detected is hardly rubbed and, thus, the wear of the outer peripheral surface of the photoreceptor drum 201 can be reduced. Therefore, the life of the photoreceptor drum 201 and the image forming unit 200 including the photoreceptor drum 201 can be prolonged.

(7-8) In the above embodiment, the case described as an example is the one where the occurrence of the linear blur is checked prior to the execution of the image forming job when the number of cumulative formed images is equal to or greater than the threshold. However, the present disclosure is obviously not limited thereto, and instead of or in addition to this configuration, the following configuration may be applied.

For example, the occurrence of the linear blur may be checked only when the time elapsed from the completion of the previous image forming processing is equal to or longer than a predetermined threshold. As described above, when the image forming processing is completed, the rotation of the photoreceptor drum 201 is stopped, and a specific region of the outer peripheral surface of the photoreceptor drum 201 continues to face the charging device 202. Therefore, the discharge products generated from the charging device 202 are intensively accumulated in the region, and if there is a damaged portion due to rubbing in the region, linear noise is likely to occur.

On the other hand, when the transfer-residual toner remaining on the outer peripheral surface of the photoreceptor drum 201 after the primary transfer is scraped off by the cleaning blade 301 during the repeated execution of the image forming processing, the discharge product is also scraped off and, thus, the linear noise is easily eliminated.

Focusing on this point, the processing for detecting the linear blur may not be executed when the time elapsed from the completion of the previous image forming processing is less than a predetermined threshold. With this configuration, it is possible to suppress wasteful toner consumption and wear of the outer peripheral surface of the photoreceptor drum 201 for cleaning the toner by unnecessarily forming the test image despite low probability of detecting the linear blur.

(7-9) In the above embodiment, the case where the photoreceptor drum 201 makes one or more rotations when the recovery mode is applied is described as an example. However, the present disclosure is obviously not limited thereto, and the photoreceptor drum 201 may make less than one rotation instead.

For example, when the linear blur is detected on the outer peripheral surface of the photoreceptor drum 201, the adhesion position where the discharge product adheres on the outer peripheral surface of the photoreceptor drum 201 can be specified. Therefore, the outer peripheral surface may be cleaned by rotating the photoreceptor drum 201 within a range in which the adhesion position passes through the rubbed position rubbed by the cleaning blade 301.

Obviously, the adhesion position passes through the rubbed position rubbed by the cleaning blade 301 before the photoreceptor drum 201 makes one rotation, except for the case where the adhesion position is located immediately below the cleaning blade 301. Therefore, the discharge product adhering to the adhesion position can be rubbed and removed by the cleaning blade 301.

With this configuration, it is possible to minimize the distance of the outer peripheral surface of the photoreceptor drum 201 rubbed by the cleaning blade 301 in order to remove the discharge product and, thus, wear of the photoreceptor drum 201 can be reduced.

In addition, due to the configuration as described in the above modification in which, after the recovery mode is applied, the linear blur detection processing is performed again, and the recovery mode is applied until the linear blur is not detected, the number of times of application of the recovery mode can be minimized. In this sense as well, wear of the photoreceptor drum 201 can be reduced.

(7-10) In the above embodiment, the case where the linear blur is detected when the cumulative number of formed images is equal to or larger than the threshold is described as an example. However, the present disclosure is obviously not limited thereto. The necessity of the execution of the linear blur detection processing may be determined using conditions other than the cumulative number of formed images, such as the running distance and the cumulative number of rotations of the photoreceptor drum 201, instead of the cumulative number of formed images. Even in this case, the same effects as those of the above embodiment can be obtained by applying the present disclosure.

(7-11) In the above embodiment, the case where the linear blur detection processing is executed at the timing at which the image forming job is received is described as an example. However, the present disclosure is obviously not limited thereto, and instead of or in addition to this configuration, the following configuration may be applied.

For example, the linear blur detection processing may be executed together with so-called image stabilization processing. The image stabilization processing refers to processing for updating an operation parameter of the image forming apparatus 1 in order to keep the image quality constant by adjusting the image density, adjusting the positional accuracy of the front and back surfaces when an image is formed on both sides of the recording sheet S, or performing other adjustments. The image stabilization processing is executed when the image forming apparatus 1 is started or stopped, when an image forming job is not being executed, or the like.

In the image stabilization processing, a test image is formed in order to detect a current operation state. Therefore, if the test image formed for the image stabilization processing is also used for detecting the linear blur, costs for toner and processing time for forming the test image can be reduced.

In addition, the linear blur detection processing may be performed only at the time of the image stabilization processing and may not be performed when the image forming job is received. With this configuration, the FCOT at the time of executing the image forming job can be shortened. Therefore, the convenience for the user can be improved.

(7-12) In the above embodiment, the case where the test image is a dot half pattern is described as an example. However, the present disclosure is obviously not limited thereto, and the following configuration may be applied instead.

For example, an image formed on the recording sheet S by the execution of the image forming job may be used as a test image and read by the scanner device 216 to detect the linear blur. When the linear blur is detected, the image is formed again after the discharge product is removed by applying the recovery mode. When the linear blur is not detected, the next image of the image forming job may be formed, or the next image forming job may be executed.

With this configuration, it is not necessary to form a test image separately from the image related to the image forming job, whereby the recording sheet S and the toner can be saved. In addition, in a case where the linear blur is not detected in the image, an image with high definition image quality is formed even if a discharge product adheres to the outer peripheral surface of the photoreceptor drum 210. Therefore, there is no problem in image quality.

This is because the linear blur due to the movement of the electrification charge does not occur when the adhesion site where the discharge product adheres does not extend across the exposed region and the unexposed region, and thus the linear blur does not occur depending on the image to be formed even if the discharge product adheres to the outer peripheral surface of the photoreceptor drum 201.

In addition, the recovery mode is applied only when an image which has a linear blur and from which the linear blur is detected is formed, and the recovery mode is not applied when an image which has no linear blur and from which the linear blur is not detected is formed, despite the adhesion of the discharge product. Therefore, this configuration can further reduce the wear of the photoreceptor drum 201 as compared with the case where the linear blur is accurately detected using an exclusive test image and the recovery mode is applied every time the linear blur is detected.

(7-13) In the above embodiment, the case where the image forming apparatus 1 is a color multi-function peripheral of a tandem system is described as an example. However, the present disclosure is obviously not limited thereto. The image forming apparatus 1 may be a color multi-function peripheral of a system other than the tandem system, or may be a monochrome multi-function peripheral.

In addition, the image forming apparatus 1 may be a single-function machine such as a printer device, a copying machine having a scanner function of reading an image from a document, or a facsimile device having a facsimile communication function, and the similar effect can be obtained by applying the present disclosure.

The image forming apparatus according to the present disclosure is useful as an apparatus capable of efficiently eliminating a linear blur which is local image noise generated by adhesion of a discharge product to a surface of a photoreceptor.

Although embodiments of the present invention have been described and illustrated in detail, the disclosed embodiments are made for purposes of illustration and example only and not limitation. The scope of the present invention should be interpreted by terms of the appended claims

What is claimed is:

1. An image forming apparatus comprising:

a toner image former that forms a toner image on an outer peripheral surface of a photosensitive rotating body and that transfers the toner image having been formed onto a transfer receiving object;

a detector that detects a grayscale abnormality of the toner image on the photosensitive rotating body or the transfer receiving object;

a cleaner that cleans the outer peripheral surface of the photosensitive rotating body; and a hardware processor that causes the cleaner to clean when the detector detects the grayscale abnormality at a same position in a main scanning direction per circumferential length of the photosensitive rotating body in a sub-scanning direction, wherein the hardware processor causes the detector to check the grayscale abnormality for each main scanning line.

2. The image forming apparatus according to claim 1, wherein the grayscale abnormality is a local grayscale abnormality in the main scanning direction.

3. The image forming apparatus according to claim 1, wherein the toner image former forms a toner image of a dot half pattern, and the detector detects the grayscale abnormality of the toner image of the dot half pattern.

4. The image forming apparatus according to claim 1, wherein the detector detects the grayscale abnormality of the toner image carried on any one of the outer peripheral surface of the photosensitive rotating body, a recording sheet, and an intermediate transfer body for transferring the toner image from the photosensitive rotating body to the recording sheet.

5. The image forming apparatus according to claim 4, wherein the toner image carried on the recording sheet is fixed on the recording sheet.

6. The image forming apparatus according to claim 1, wherein the cleaner cleans an entire circumference of the photosensitive rotating body.

7. The image forming apparatus according to claim 1, further comprising an image stabilization processor that causes the toner image former to form the toner image in order to stabilize quality of the toner image, wherein the detector detects the grayscale abnormality at a timing at which the image stabilization processor executes processing for stabilizing the quality.

8. The image forming apparatus according to claim 7, wherein the detector detects the grayscale abnormality of the toner image formed by the toner image former that is caused to form the toner image by the image stabilization processor.

9. The image forming apparatus according to claim 1, wherein the detector detects the grayscale abnormality of the toner image that is formed when a predetermined time or more has elapsed since previous formation of the toner image by the toner image former.

10. The image forming apparatus according to claim 1, wherein the cleaner cleans the outer peripheral surface of the photosensitive rotating body by supplying toner onto the outer peripheral surface and scraping off the toner.

11. The image forming apparatus according to claim 1, wherein the toner image former further forms the toner image after cleaning by the cleaner, the detector detects the grayscale abnormality of the toner image which has been further formed, and the detector includes a notifier notifying that the grayscale abnormality has been detected, in the toner image which has been further formed, at a same position in the main scanning direction per circumferential length of the photosensitive rotating body in the sub-scanning direction.

12. An image forming apparatus comprising:

a toner image former that forms a toner image on an outer peripheral surface of a photosensitive rotating body and that transfers the toner image having been formed onto a transfer receiving object;

a detector that detects a grayscale abnormality of the toner image on the photosensitive rotating body or the transfer receiving object;

a cleaner that cleans the outer peripheral surface of the photosensitive rotating body; and a hardware processor that causes the cleaner to clean when the detector detects the grayscale abnormality at a same position in a main scanning direction per circumferential length of the photosensitive rotating body in a sub-scanning direction, wherein the image forming apparatus further comprises:

a durability state specifying part that specifies a durability state of the photosensitive rotating body; and a prohibitor that prohibits the detector from detecting the grayscale abnormality when the durability state is equal to or less than a threshold.

13. An image forming apparatus comprising:

a toner image former that forms a toner image with a predetermined line width on an outer peripheral surface of a photosensitive rotating body and that transfers the toner image having been formed onto a transfer receiving object;

a detector that detects a line width abnormality of the toner image on the photosensitive rotating body or the transfer receiving object;

a cleaner that cleans the outer peripheral surface of the photosensitive rotating body; and a hardware processor that causes the cleaner to clean when the detector detects the line width abnormality at a same position in a main scanning direction per circumferential length of the photosensitive rotating body in a sub-scanning direction, wherein the hardware processor causes the detector to check the line width abnormality for each sub-scanning line.

14. The image forming apparatus according to claim 13, wherein the line width abnormality is a local line width abnormality in the main scanning direction.

15. The image forming apparatus according to claim 13, wherein the toner image with the predetermined line width is a line pattern provided at a constant interval in the sub-scanning direction.

16. The image forming apparatus according to claim 13, wherein the detector detects the line width abnormality of the toner image carried on any one of the outer peripheral surface of the photosensitive rotating body, a recording sheet, and an intermediate transfer body for transferring the toner image from the outer peripheral surface of the photosensitive rotating body onto the recording sheet.

17. The image forming apparatus according to claim 16, wherein the toner image carried on the recording sheet is fixed on the recording sheet.

18. The image forming apparatus according to claim 13, wherein the cleaner cleans an entire circumference of the photosensitive rotating body.

19. The image forming apparatus according to claim 13, further comprising an image stabilization processor that causes the toner image former to form the toner image in order to stabilize quality of the toner image, wherein the detector detects the line width abnormality at a timing at which the image stabilization processor executes processing for stabilizing the quality.

20. The image forming apparatus according to claim 19, wherein the detector detects the line width abnormality of the toner image formed by the toner image former that is caused to form the toner image by the image stabilization processor.

21. The image forming apparatus according to claim 13, wherein the detector detects the line width abnormality of the toner image that is formed when a predetermined time or more has elapsed since previous formation of the toner image by the toner image former.

22. The image forming apparatus according to claim 13, wherein the cleaner cleans the outer peripheral surface of the photosensitive rotating body by supplying toner onto the outer peripheral surface and scraping off the toner.

23. The image forming apparatus according to claim 13, wherein the toner image former further forms the toner image after cleaning by the cleaner, the detector detects the line width abnormality of the toner image which has been further formed, and the detector includes a notifier notifying that the line width abnormality has been detected, in the toner image which has been further formed, at a same position in the main scanning direction per circumferential length of the photosensitive rotating body in the sub-scanning direction.

24. An image forming apparatus comprising:

a toner image former that forms a toner image with a predetermined line width on an outer peripheral surface of a photosensitive rotating body and that transfers the toner image having been formed onto a transfer receiving object;

a detector that detects a line width abnormality of the toner image on the photosensitive rotating body or the transfer receiving object;

a cleaner that cleans the outer peripheral surface of the photosensitive rotating body; and a hardware processor that causes the cleaner to clean when the detector detects the line width abnormality at a same position in a main scanning direction per circumferential length of the photosensitive rotating body in a sub-scanning direction, wherein the image forming apparatus further comprises:

a durability state specifying part that specifies a durability state of the photosensitive rotating body; and a prohibitor that prohibits the detector from detecting the line width abnormality when the durability state is equal to or less than a threshold.

* * * * *